US006661386B1

(12) United States Patent
Petros et al.

(10) Patent No.: US 6,661,386 B1
(45) Date of Patent: Dec. 9, 2003

(54) THROUGH GLASS RF COUPLER SYSTEM

(75) Inventors: Argy Petros, Lake Worth, FL (US); Terry C. Helstrom, Boynton Beach, FL (US); Karl R. Guppy, Coconut Creek, FL (US)

(73) Assignee: XM Satellite Radio, Washington, DC (US)

( * ) Notice: Subject to any disclaimer, the term of this patent is extended or adjusted under 35 U.S.C. 154(b) by 0 days.

(21) Appl. No.: 10/108,349

(22) Filed: Mar. 29, 2002

(51) Int. Cl.[7] ..... H01Q 1/32

(52) U.S. Cl. ..... 343/713; 343/700 MS; 333/24 C

(58) Field of Search ..... 343/713, 715, 343/700 MS, 767, 906; 333/24 C

(56) References Cited

U.S. PATENT DOCUMENTS

| | | | | | |
|---|---|---|---|---|---|
| 4,130,822 | A | | 12/1978 | Conroy | 343/700 MS |
| 4,197,545 | A | | 4/1980 | Favaloro et al. | 343/700 MS |
| 4,792,809 | A | | 12/1988 | Gilbert et al. | 343/770 |
| 4,931,806 | A | * | 6/1990 | Wunderlich | 343/715 |
| 5,448,250 | A | * | 9/1995 | Day | 343/700 MS |
| 5,451,966 | A | * | 9/1995 | Du et al. | 343/715 |
| 5,565,877 | A | | 10/1996 | Du et al. | 343/715 |
| 5,793,263 | A | | 8/1998 | Pozar | 333/26 |
| 5,898,408 | A | * | 4/1999 | Du | 343/715 |
| 6,172,651 | B1 | * | 1/2001 | Du | 343/850 |
| 6,191,747 | B1 | * | 2/2001 | Cosenza | 343/749 |
| 6,215,451 | B1 | * | 4/2001 | Hadzoglou | 343/715 |
| 6,232,926 | B1 | * | 5/2001 | Nguyen et al. | 343/713 |

OTHER PUBLICATIONS

Electronics Letters, vol. 21, No. 2, pp. 49–50, Jan. 17, 1985.

IEEE Transactions, vol. AP–34, No. 8, pp. 977–984, Aug. 1986 "Analysis of an Aperture Coupled Microstrip Antenna", Sullivan et al.

IEEE Transactions, vol. AP–34, No. 12, pp. 1439–1444, Dec. 1986, "A Reciprocity Method of Analysis for Printed Slot and Slot–Coupled Microstrip Antenna", Pozar.

Electronics Letters, vol. 24, No. 23, pp. 1433–1435, Nov. 10, 1986.

Electronics Letters, vol. 27, No. 13, pp. 1129–1131, Jun. 20, 1991.

IEEE Transactions, vol. 40, No. 5, pp. 469–481, May 1992 "Multiport Scattering Analysis of General Multi–Layered Printed Antennas Fed by Multiple Feed Ports, Part I" Das et al.

IEEE Transactions, vol. 40, No. 5, pp. 482–491, May 1992.

IEEE Transactions, vol. 41, No. 2, pp. 214–220, Feb. 1993 "Design of Wideband Circularly Polarized Aperature-Coupled Microstrip Antennas", Targonski et al.

Electronics Letters, vol. 21, pp. 49–50, Jan. 17, 1985, "Microstrip Antenna Aperature–Coupled to a Microstrip-line," D.M. Pozar.

* cited by examiner

*Primary Examiner*—Tan Ho
(74) *Attorney, Agent, or Firm*—Shaw Pittman LLP

(57) ABSTRACT

A radio frequency (RF) coupler for passing RF energy through a dielectric such as glass, includes first and second circuit boards, each board having disposed thereon an electrical conducting material, the first and second circuit boards being arranged opposite each other on opposing sides of the dielectric, the first circuit board having a first ground element that defines a first aperture, and a first exciter strip disposed within the first aperture, the second circuit board having a second ground element that defines a second aperture, and a second exciter strip disposed within the second aperture, wherein one of the first and second exciter strips is longer than the other.

26 Claims, 2 Drawing Sheets

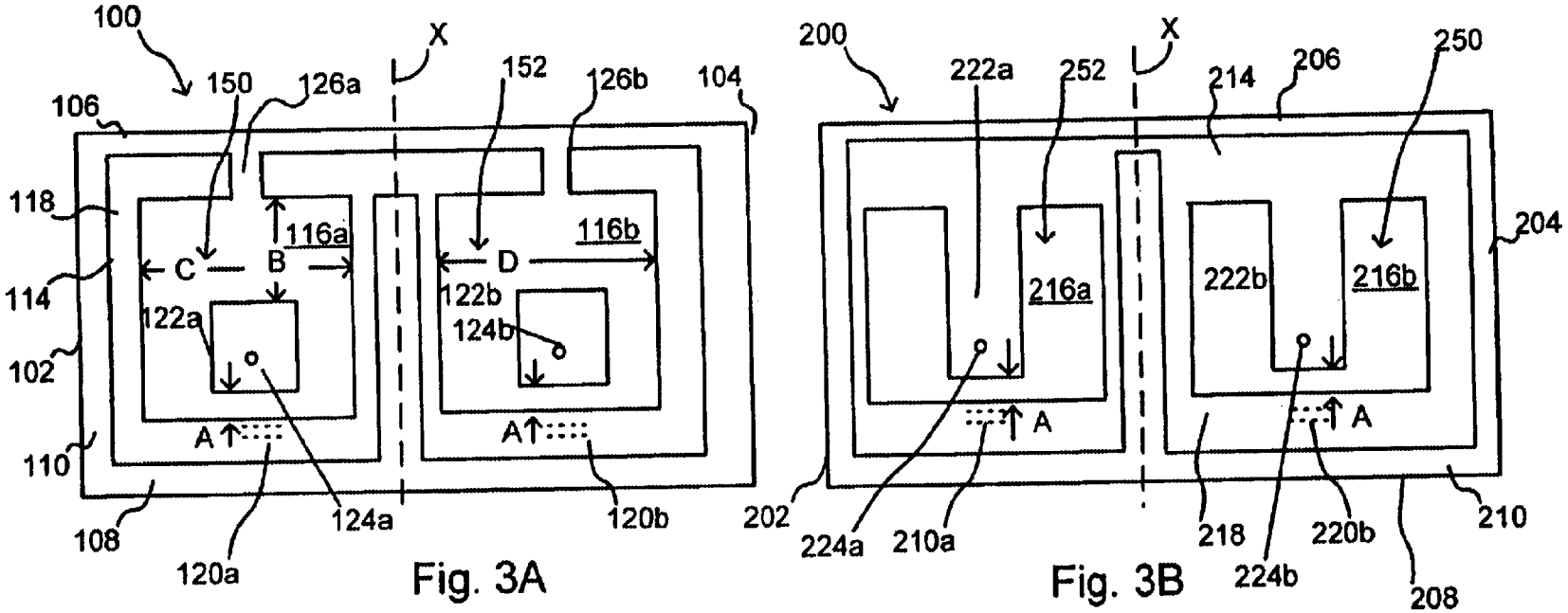
Fig. 3A
Fig. 3B
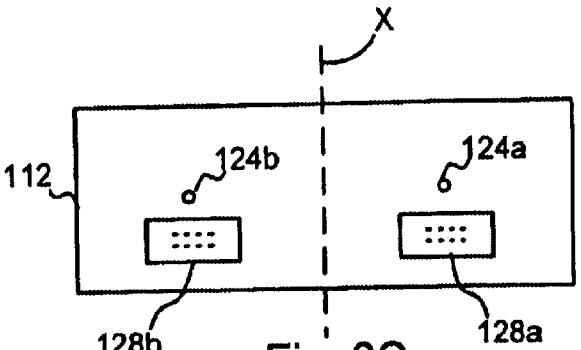
Fig. 3C

THROUGH GLASS RF COUPLER SYSTEM

BACKGROUND

1. Field of the Invention

The present invention relates generally to radio frequency (RF) components. More particularly, the present invention relates to couplers that couple RF signals, including ultra high frequency signals, through a medium such as air, glass or other dielectric.

2. Background of the Invention

Through-glass couplers, as explained in, e.g., U.S. Pat. No. 5,565,877 to Du et al., are employed to RF couple two antenna modules that are mounted, respectively, on the outside and inside surfaces of window glass, such as automobile glass, to transmit signals through the window glass between the opposing modules. The outside antenna module might include a vertically extending antenna element, while the inside antenna module typically contains a connector or transmission feedline, which leads to a device such as a telephone, pager, facsimile machine, radio receiver, or the like, inside the vehicle. In a radio receiver implementation, the inside antenna module receives RF energy through the glass from the outside antenna module.

Loss occurs in glass mount antennas due to the dielectric material interposed between the inside and outside modules, as well as impedance mismatching. Therefore, a window glass mount antenna typically has lower gain compared to a non-through-glass antenna. However, conventional (i.e., non-through-glass coupled) antennas are less desirable because there must be a physical connection that extends through the body of a vehicle, between inside and outside antenna modules.

Conventional through-glass couplers employ capacitive coupling to transmit RF signals through the glass. In capacitively coupled antennas, two metal plates are positioned opposite each other on opposing surfaces of the window glass. These metal plates cooperate and act as a capacitor to transmit RF energy through the intervening window glass. However, to achieve better responses, especially at relatively higher frequencies, microstrip antennas have been adopted in certain applications, as exemplified by U.S. Pat. No. 5,565,877 to Du et al. There are many variations to microstrip antenna designs, as exemplified by, e.g., U.S. Pat. No. 4,130,822 to Conroy, U.S. Pat. No. 4,197,545 to Favaloro et al., U.S. Pat. No. 4,792,809 to Gilbert et al. and U.S. Pat. No. 5,793,263 to Pozar, but because of the wide array of applications for which microstrip antennas can be used, there is significant room for improvement in microstrip antenna design, particularly in specialized applications.

FIG. 1 illustrates a typical application for which a through-glass coupler is employed. In the case of, for example, a radio receiver implementation (although the same principles apply to a radio transceiver implementation) an antenna 10, receives a broadcast signal, which is applied to an outside module 200 of a through glass coupler 12. Outside module 200 is positioned against glass 14 and opposite inside module 100 on the opposite side of the glass 14. In some applications, a matching circuit 16 is preferably provided to match impedance values of the two complementary modules 100, 200. A radio frequency (RF) cable 18, e.g., coaxial cable, typically connects matching circuit 16 to a low noise amplifier (LNA) 20, which feeds receiver 22.

Of the known methods of transferring RF energy through glass, capacitive coupling, slot coupling, and aperture coupling represent the most common. However, an inherent drawback of all these coupling methods is that they increase the system noise due to relatively high RF coupling loss. To reduce coupling losses, the methods listed above need to be implemented on expensive circuit board ceramic material (i.e., Rogers 3003, 4003, 3010, etc.). The price of these materials, however, is significantly higher than that of, e.g., standard FR-4 printed circuit board. Thus, using low-loss type boards would make a consumer product very expensive.

Also, a typical slot coupler, as shown in FIG. 2, includes a circuit board 50, a microstrip feed line 52 and a slot 54 that exposes the underlying microstrip feed line 52. Such a device requires elaborate construction techniques, and may require the use of relatively expensive multi-layer boards. There is a need, therefore, for providing a less expensive coupler, yet one that provides the performance that matches or even exceeds known devices that are constructed using higher cost materials.

SUMMARY OF THE INVENTION

It is therefore an object of the present invention to provide a low cost yet capable through glass coupler.

It is another object of the present invention to provide a coupler that is simple to manufacture.

It is yet another object of the present invention to provide a through glass coupler that has inside and outside modules having asymmetrical configurations.

It is also an object of the present invention to provide components of a pair of through glass couplers on a single board.

It is also an object of the present invention to provide a through glass coupler that can be constructed using well-known etching techniques and low-cost copper clad circuit board material.

It is still another object of the present invention to provide a through glass coupler having a low profile design.

It is also an object of the present invention to provide a through glass coupler that not only has a low profile design, but also does not require a cavity, i.e., a slot.

To achieve the foregoing and other objects, an embodiment of the present invention comprises a pair of single layer double sided copper clad boards that are etched to include apertures and exciter strips that have different configurations. In a particular application for the through glass coupler of the invention, each copper clad board is etched to include components of two couplers, whereby two antennas or frequency bands can be accommodated and coupled.

Further in accordance with embodiments of the invention, the through glass coupler comprises a single layer design, thereby substantially facilitating the manufacture thereof. Additionally, no cavities are required, thereby achieving further savings in manufacturing costs and space.

BRIEF DESCRIPTION OF THE DRAWINGS

The present invention will be more fully explained in the following detailed description of the invention in conjunction with the associated drawings, in which

FIGS. 3A–3C illustrate front faces and a back face of a dual RF coupler pair embodiment in accordance with the present invention.

DETAILED DESCRIPTION OF THE INVENTION

FIGS. 3A–3C illustrate an exemplary embodiment of the present invention in which two separate RF signals can be passed through a dielectric, such as glass on a vehicle.

Generally, in accordance with the principles of the present invention, low loss is achieved by making the opposing couplers different. For example, as shown in FIGS. 3A–3B generally, and as will be explained in more detail below, one printed exciter strip on one circuit board or module is floating, while the printed exciter strip on the other circuit board or module is shorted to ground. The length of the printed exciter strips can be adjusted for tuning to the desired frequency and minimizing coupler loss.

Figure 1:
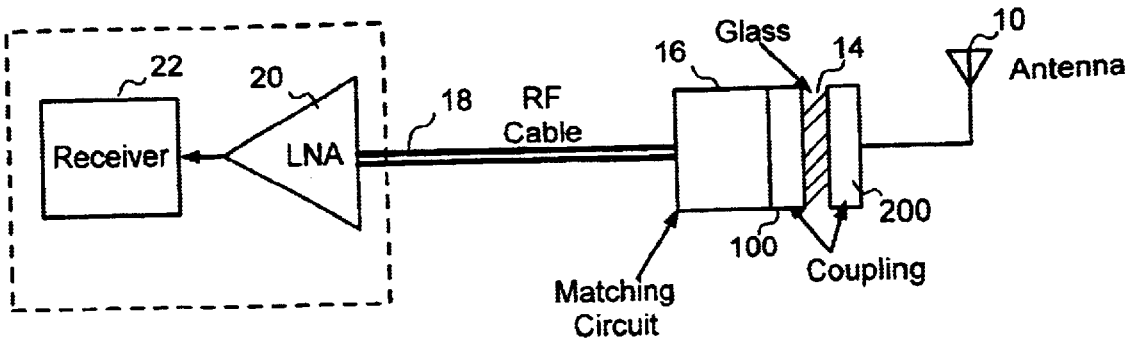
FIG. 1 illustrates a typical application for which a through glass coupler might be used.

Consistent with the application shown in FIG. 1, the through glass coupler in accordance with the present invention comprises an inside module 100 and an outside module 200. Inside module 100, which would typically be located inside a vehicle, comprises a circuit board having a left side edge 102, a right side edge 104, a top edge 106 and a bottom edge 108. In addition, the substantially rectangular inside module 100 comprises a front face 110 and a back face 112, the latter being shown in FIG. 3C. In accordance with the illustrative embodiment, two couplers, a first coupler 150 and a second coupler 152 are provided on the same inside module 100. This permits two separate RF frequencies to be passed through the dielectric. The dashed line indicated by X denotes the separation between the first coupler 150 and the second coupler 152. Of course, the present invention can be configured to have only a single coupler per module. Also, although not shown in the drawings, modules 100 and 200 preferably include a cover that encapsulates at least an exposed portion of the circuit boards when they are mounted on glass.

Inside module 100 (as well as outside module 200) is preferable constructed of well known and inexpensive copper-clad circuit board material such as FR-4. The copper cladding 114 preferably etched using well known techniques to arrive at the exemplary configuration shown in FIGS. 3A–3B.

More specifically, the copper cladding 114 is preferably etched such that apertures 116*a* and 116*b* are provided in each of the first and second couplers 150, 152. Further, exciter strips 122*a* and 122*b* are provided within each of apertures 116*a* and 116*b*. The exciter strips 122*a*, 122*b* each includes a feed point through hole 124*a* and 124*b*. A ground element 118 preferably includes a ground connection area 120 that includes a plurality of relatively small through holes to ensure a secure solder joint. Also, ground element 118 preferably includes gaps 126*a* and 126*b* adjacent top edge 106.

Back face 112 is the back face of inside module 100. A similar back face is provided for outside module 200, although, for simplicity, this back face is not shown. Back face 112 includes feed point through holes 124*a* and 124*b* as well as separate ground connection area pads. 128*a* and 128*b*, which correspond, in location, substantially with the ground connection areas 120*a* and 120*b* on the front face 110.

Outside module 200 comprises a circuit board having a left side edge 202, a right side edge 204, a top edge 206 and a bottom edge 208. Outside module 200 further comprises a front face 210 shown in FIG. 3B and a back face (not shown) that is similar to back face 112 shown in FIG. 3C. Like inside module 100, outside module 200 comprises a first coupler 250 and a second coupler 252.

Apertures 216*a* and 216*b* are etched from copper cladding 214, a ground element 218, which extends substantially around a periphery of the circuit board, as well as exciter strips 222*a* and 222*b* are provided. Ground connection areas 220*a* and 220*b*, including several pin holes that extend through the circuit board, are preferably provided, as are feed point through holes 224*a* and 224*b*.

The separation between the two couplers 250 and 252 is indicated by the dashed line Y. In use, the front faces 110 and 210 of the inside module 100 and outside module 200 face each other on opposing sides of a dielectric such as a piece of glass. The two modules 100, 200 preferably have the same overall outer dimensions such that they can be aligned directly opposite each other and in registration with one another. Indeed, when the two modules oppose each other complementary pairs of feed point through holes 124*a*, 124*b*, 224*a*, 224*b*, as well as ground connection areas 120*a*, 120*b*, 220*b*, 220*a* preferably align, or are in registration, with each other. Center conductors of coaxial conductors (not shown) can be soldered to the feed point through holes, and outer ground sheathing of the coaxial cable can be connected and/or soldered to the ground connection areas 120 and/or ground connection area pads 128.

Figure 2:
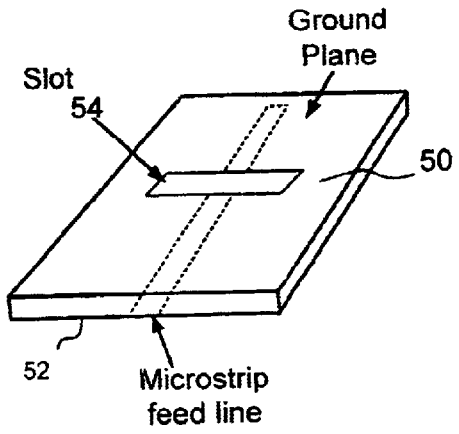
Figure 2 PRIOR ART
FIG. 2 depicts a prior art microstrip-fed slot coupler.

The exciter strip configurations of the two boards is a significant aspect of the present invention. Specifically, as shown in the FIGS. 3A and 3B the corresponding inside and outside modules have different exciter strip configurations. Specifically, it can be readily seen that exciter strips 222*a*, 222*b* extend to an upper portion of ground element 218, and are indeed integrally formed therewith, as compared with "floating" exciter strips 122*a*, 122*b*. Accordingly, one of ordinary skill in the art can readily appreciate that opposing inside and outside modules have different configurations. This aspect of the present invention is unlike well known capacitively coupled through glass couplers that employ simple metallic plates. Also, the present invention is different from prior art devices in that a simple dual side copper clad board can be employed to achieve a low loss through glass coupler without having to resort to expensive and intricate construction techniques to achieve a slot type micro strip antenna like that shown in FIG. 2.

The dimensions shown in FIGS. 3A and 3B are also instructive with respect to illustrating the relative sizes of the different elements included on each of the inside and outside modules. For example, dimension A, which measures the distance between an exciter strip and its closest portion of ground element 118, is preferably substantially the same for each coupler. Dimension B measures the distance between an edge of exciter strip 122*a*, 122*b* and an upper portion of ground element 118, while dimensions C and D illustrate how the aperture widths of the first and second couplers 150, 152 can be different, thereby, accommodating different levels of loss.

Thus, the two modules described herein, when properly aligned on opposite sides of a dielectric, can pass RF signals of two separate antennas. The isolation between the two couplers is approximately 30 dB. In an actual application of the RF coupler of the invention, the coupler is used to couple through glass terrestrial based signals and space based signals. It is noted that while differently sized apertures have been described and shown, different applications may call for similarly sized apertures. The RF coupler described herein, however, was developed in connection with a satellite digital audio radio service (SDARS) that comprises a space based broadcast signal and a terrestrial based broadcast signal. Because in this particular application the terrestrial based signal is stronger than the space based signal (which is broadcast at a different frequency), the aperture corresponding to the terrestrial coupler is made smaller than the aperture for the space based (or satellite) signal. While, the smaller aperture will cause additional loss in the terrestrial coupler system, the SDARS system can nevertheless tolerate this loss. Based on a coupler having an overall length of 2.9 inches, an overall width of 1.1 inches, a satellite signal coupler having an aperture width of 1.55 inches and a terrestrial signal coupler having an aperture width of 1.26 inches, the coupling loss is as follows: satellite signal coupling loss: 0.5–0.6 dB, terrestrial signal coupling loss: 1.0–1.1 dB (based on 4-mm thick automotive glass).

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

What is claimed is:

1. A through glass coupler, comprising:

a first module comprising a first circuit board having a left side edge, a right side edge, a top edge and a bottom edge, the circuit board of the first module further having a front face and a back face, the front face having a ground element that is disposed adjacent at least one of said right side edge and said left side edge and at least one of said top edge and said bottom edge, the front face of the first circuit board further having a first module exciter strip disposed within an aperture defined at least in part by the ground element; and a second module comprising a second circuit board having a left side edge, a right side edge, a top edge and a bottom edge, the second circuit board of the second module further having a front face and a back face, the front face having a ground element that is disposed adjacent at least one of said right side edge and said left side edge and at least one of said top edge and said bottom edge, the front face of the second circuit board further having a second module exciter strip disposed within an aperture defined at least in part by the ground element, wherein the second module exciter strip is longer than the first module exciter strip in at least one dimension, and wherein the ground element of the first circuit board comprises a gap between portions of the ground element.

2. The through glass coupler of claim 1, wherein the ground element of the first and second circuit boards is disposed adjacent at least three edges.

3. The through glass coupler of claim 1, wherein the second module exciter strip is in electrical communication with the ground element of the second circuit board.

4. The through glass coupler of claim 3, wherein the second module exciter strip is integrally formed with the ground element of the second circuit board.

5. The through glass coupler of claim 1, wherein at least one of the exciter strips comprises a feed point.

6. The through glass coupler of claim 5, wherein the feed point comprises a through hole.

7. The through glass coupler of claim 1, wherein at least one of the ground elements comprises a ground connection area disposed adjacent a corresponding one of the exciter strips.

8. The through glass coupler of claim 1, wherein the back face of at least one of the circuit boards comprises a ground connection area pad.

9. The through glass coupler of claim 1, wherein each of the first and second modules comprises more than one exciter strip.

10. The through glass coupler of claim 9, wherein the first and second modules are configured to receive, respectively, a space based signal source and a terrestrial based signal source.

11. The through glass coupler of claim 1, wherein each of the first and second modules comprises more than one aperture.

12. The through glass coupler of claim 11, wherein different apertures associated with the same module are sized differently in at least one dimension.

13. The through glass coupler of claim 12, wherein a width of all exciter strips is substantially the same.

14. The through glass coupler of claim 1, wherein the front face of the first circuit board faces the front face of the second circuit board on opposite sides of a dielectric.

15. A radio frequency (RF) coupler for passing RF energy through a dielectric, the coupler comprising:

first and second circuit boards, each board having disposed thereon an electrical conducting material, the first and second circuit boards being arranged opposite each other on opposing sides of the dielectric, the first circuit board comprising a first ground element that defines a first aperture, and a first exciter strip disposed within the first aperture, the second circuit board comprising a second ground element that defines a second aperture, and a second exciter strip disposed within the second aperture, wherein one of the first and second exciter strips is longer than the other, and wherein the first ground element comprises a gap between portions thereof.

16. The RF coupler of claim 15, wherein the circuit boards are copper clad circuit boards.

17. The RF coupler of claim 15, wherein the second exciter strip is in electrical communication with the second ground element of the second circuit board.

18. The RF coupler of claim 17, wherein the second exciter strip is integrally formed with the second ground element.

19. The RF coupler of claim 15, wherein at least one of the exciter strips comprises a feed point.

20. The RF coupler of claim 19, wherein the feed point comprises a through hole.

21. The RF coupler of claim 15, wherein at least one of the ground elements comprises a ground connection area disposed adjacent a corresponding one of the exciter strips.

22. The RF coupler of claim 15, wherein a back face of at least one of the circuit boards comprises a ground connection area pad.

23. The RF coupler of claim 15, wherein each of the first and second circuit boards comprises more than one exciter strip.

24. The RF, coupler of claim 23, wherein the first and second circuit boards are configured to couple, respectively, a space based signal source and a terrestrial based signal source.

25. The RF coupler of claim 23, wherein each of the first and second circuit boards comprises differently sized apertures.

26. The RF coupler of claim 23, wherein a width of all exciter strips is substantially the same.

* * * * *